US009222229B1

(12) United States Patent
Chang et al.

(10) Patent No.: US 9,222,229 B1
(45) Date of Patent: Dec. 29, 2015

(54) TUNABLE SANDWICH-STRUCTURED ACOUSTIC BARRIERS

(71) Applicant: HRL Laboratories, LLC, Malibu, CA (US)

(72) Inventors: Chia-Ming Chang, Agoura Hills, CA (US); Geoffrey P. McKnight, Los Angeles, CA (US); William Carter, Calabasas, CA (US); Alan J. Jacobsen, Woodland Hills, CA (US); Tobias A. Schaedler, Oak Park, CA (US); Adour V. Kabakian, Monterey Park, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 14/298,858

(22) Filed: Jun. 6, 2014

Related U.S. Application Data

(60) Provisional application No. 61/889,530, filed on Oct. 10, 2013.

(51) Int. Cl.
*E04B 1/82* (2006.01)
*E01F 8/00* (2006.01)

(52) U.S. Cl.
CPC ..... *E01F 8/00* (2013.01)

(58) Field of Classification Search
CPC ..... E94B 1/82
USPC ..... 181/207
See application file for complete search history.

(56) References Cited

U.S. PATENT DOCUMENTS

| | | | | |
|---|---|---|---|---|
| 4,149,612 | A | 4/1979 | Bschorr | |
| 4,325,461 | A | 4/1982 | Bschorr | |
| 5,241,512 | A * | 8/1993 | Argy et al. | 367/1 |
| 5,851,626 | A | 12/1998 | McCorry et al. | |
| 7,249,653 | B2 * | 7/2007 | Sheng et al. | 181/290 |
| 7,263,028 | B2 | 8/2007 | Thomas et al. | |
| 7,382,959 | B1 | 6/2008 | Jacobsen | |
| 7,395,898 | B2 * | 7/2008 | Yang et al. | 181/286 |

(Continued)

FOREIGN PATENT DOCUMENTS

| | | |
|---|---|---|
| GB | 887535 | 3/1959 |
| KR | 20-1999-0025038 | 7/1999 |

OTHER PUBLICATIONS

Geoffrey P. McKnight, et al., U.S. Appl. No. 13/645,250; Title: High bandwidth antiresonant membrane, filed Oct. 4, 2012.

(Continued)

*Primary Examiner* — Forrest M Phillips
(74) *Attorney, Agent, or Firm* — Christopher R. Balzan

(57) ABSTRACT

In one embodiment, provided is a sound attenuating barrier having a core structure between face sheets with a mass attached to at least one face sheet, and having a spatially varied stiffness distribution and/or a spatially varied density. The sound attenuating barrier may include at least one face sheet and/or core having a spatially varied stiffness distribution and/or a spatially varied mass distribution. In one embodiment, a sound attenuating barrier is provided having a core structure between face sheets with a mass structure attached to at least one face sheet, with the core/and or face sheet(s) being constructed to design an effective vibration length as well as enable a variable local stiffness and mass across the sound attenuating barrier such that the sandwich structure provides variable resonance frequency responses and broadband coverage.

31 Claims, 10 Drawing Sheets

(56) References Cited

U.S. PATENT DOCUMENTS

| | | | | |
|---|---|---|---|---|
| 7,510,052 | B2 | 3/2009 | Ayle | |
| 7,653,279 | B1 | 1/2010 | Jacobsen | |
| 8,047,329 | B1 | 11/2011 | Douglas et al. | |
| 8,066,098 | B2 | 11/2011 | Ayle | |
| 8,079,443 | B2 | 12/2011 | Keller | |
| 8,367,184 | B2 | 2/2013 | Slama et al. | |
| 8,544,597 | B1 * | 10/2013 | McEnerney | 181/207 |
| 8,616,330 | B1 * | 12/2013 | McKnight et al. | 181/207 |
| 8,752,667 | B2 * | 6/2014 | McKnight et al. | 181/287 |
| 8,869,933 | B1 * | 10/2014 | McKnight et al. | 181/286 |
| 8,960,365 | B2 * | 2/2015 | Sheng et al. | 181/207 |
| 2005/0279574 | A1 | 12/2005 | Halterbeck et al. | |
| 2006/0065474 | A1 | 3/2006 | Niwa et al. | |
| 2008/0085020 | A1 * | 4/2008 | Tsai et al. | 381/178 |
| 2008/0099609 | A1 | 5/2008 | Drost | |
| 2011/0064259 | A1 * | 3/2011 | Liu et al. | 381/398 |
| 2013/0087407 | A1 * | 4/2013 | McKnight et al. | 181/287 |

OTHER PUBLICATIONS

Geoffrey P. McKnight, et al., USPTO Notice of Allowance, mailed Feb. 10, 2014 for U.S. Appl. No. 13/645,250 Title: High bandwidth antiresonant membrane, filed Oct. 4, 2012.

Chia-Ming Chang, et al., U.S. Appl. No. 13/952,995; Title: Acoustic barrier support structure, filed Jul. 29, 2013.

Chia-Ming Chang, et al., U.S. Appl. No. 13/953,155; Title: Hybrid Acoustic barrier and absorber, filed Jul. 29, 2013.

Alan J. Jacobsen, et al. Shear behavior of polymer micro-scale truss structures formed from self-propagating polymer waveguides; Acta Materialia 56 (2008); pp. 1209-1218.

* cited by examiner

TUNABLE SANDWICH-STRUCTURED ACOUSTIC BARRIERS

CROSS REFERENCE TO RELATED APPLICATION

This application claims the benefit of U.S. Provisional Application 61/889,530, entitled TUNABLE SANDWICH-STRUCTURED ACOUSTIC BARRIERS, filed Oct. 10, 2013, herein incorporated by reference in its entirety.

BACKGROUND

Conventional passive noise control approaches, such as sound absorbers or blockers, are typically either gigantic or heavy, especially for the low frequency noise control. Conventional active noise control provides another noise control option, but, its wiring and power requirement can make conventional active noise control costly, complex and hard to implement.

Further, conventional composite acoustic attenuation concepts are too heavy and bulky for certain applications. Some approaches rely on structural tension and lack stiffness control, or can be heavy if many masses are involved. Yet others have an operating frequency that is high, which makes it less effective for low-frequency operation. Another problem encountered with some conventional structures is that preciseness can be difficult to achieve as the environmental temperature changes.

The conventional noise control materials such as foams, blankets, barriers, and Helmholtz resonators rely either on homogenized material properties or dynamic behavior to reduce the noise. In the homogenized property category, the bulk materials reflect acoustic energy based on the mass law which depicts 6 dB noise reduction as doubling the frequency or surface density and the absorbent materials dissipate the energy with comparable thickness with at least one quarter of wave length. For low frequency noise control applications, the materials or the structure must be either extreme bulky and heavy to be able to provide adequate noise reduction and hence impractical for lightweight and compact requirements of modern vehicle design. As for the dynamic approaches, structural or acoustic resonators are constructed to control the noise with designated stop band frequency range; however, it is usually narrow band and less effective as frequency decreases. Further, since structural resonators with low stiffness such as membrane or thin plate often rely on structural tension to increase operation frequency which is often sensitive to environment temperature, tensioned structures resonators suffer from frequency drifting for applications with serious temperature change.

Thus, what is needed is a lightweight and compact design that is broadband and effective at low frequencies. Further, what is needed is a technology that reduces manufacturing costs and reduces environmental sensitivity to temperature or moisture.

SUMMARY

In one embodiment, the sound attenuating barrier includes a core structure between face sheets. A mass structure is attached to at least one of the face sheets. The sound attenuating barrier further includes a spatially varied stiffness distribution across the sound attenuation barrier, a spatially varied density across the sound attenuation barrier, or both.

In various embodiments, the sound attenuating barrier may include at least one face sheet having a spatially varied stiffness distribution, a spatially varied mass distribution, a spatially varied stiffness distribution, a spatially varied mass distribution, or any combination of these.

In one embodiment, a sound attenuating barrier is provided having face sheets with a core structure therebetween. A mass structure is attached to at least one of the face sheets, either outside the sandwich structure or in between the face sheets. At least one of geometry or dimension being configured to provides shorter effective length of resonances such that the sandwich structure resonators provide high resonance frequency responses and broadband coverage.

DESCRIPTION OF THE DRAWINGS

These and other features, aspects, and advantages of the present invention will become better understood with reference to the following description, appended claims, and accompanying drawings where:

DESCRIPTION

Figure 1A:
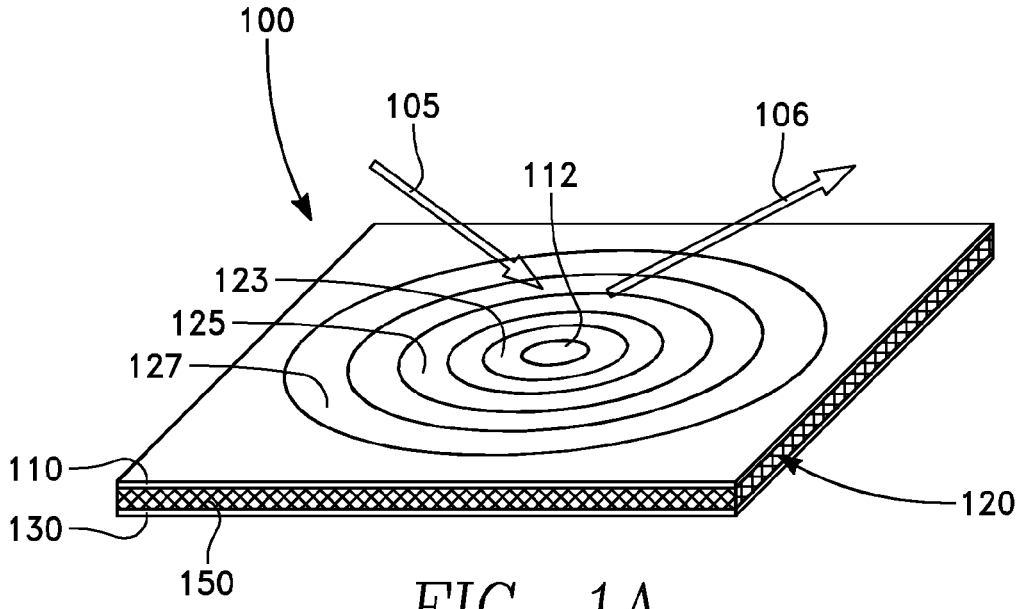
FIG. 1A is a perspective view of a sandwich-structured acoustic barrier.

In various embodiments, an architected acoustic sandwich-structured barrier is a panel composed of a core structure and face sheets with variable local stiffness and density, which blocks acoustic energy. Various embodiments use variable stiffness and mass distribution across the sandwiched structure to construct a tunable and broadband anti-resonance sound barrier.

Besides benefiting from sandwich panel configurations, high bending stiffness can be achieved without mass penalty and structural tension, which enables compact, lightweight, noise and vibration control with high temperature tolerance in harsh chemical and/or humidity environment. The nature of high bending stiffness makes various embodiments a good candidate for multifunctional noise control, providing both acoustic isolation and structural support or mechanical loads. It is conceivable that the concept can be integrated into generic panel construction approaches to yield the added benefit of targeted noise control to applications that currently use sandwich panels.

In various embodiments, it is possible to create a lightweight, compact, and scalable noise blocking panel with high temperature tolerance and robustness in harsh environment. By designing core materials such as honeycomb, or truss architecture, and face sheets with a variable stiffness and density distribution, various embodiments of the sandwich panel may provide a compact, lightweight noise control treatment which is not only scalable, easy manufacture, and temperature insensitive, but can be constructed into a protecting case for mechanical and/or electrical components.

Thus, in various embodiments it is possible to use compact and lightweight sandwiched core structure with variable stiffness and mass design to provide noise control at low or mid audible frequency (30-1000 Hz) which is challenging for conventional noise control. The face sheet construction and the non-tension design may provide high temperature tolerance and good robustness in harsh environments.

In accordance with some embodiments, a non-tension design is possible, as well as a tailored variable stiffness or mass. Furthermore, some embodiments may provide a compact, lightweight, robust architected acoustic blocking panel with high noise reduction at ultra-low frequencies and good temperature tolerance for noise control. Various embodiments can provide a passive noise control solution with advantages of low weight, compactness, high noise reduction, and environmental robustness.

Various embodiments may utilize scalable, flexible, and conformal truss/lattice fabrication technique, such as for example microtruss, to benefit lightweight acoustic barriers technology. Various embodiments may provide noise control or acoustic blocking in vehicles, such as automobiles and aircraft, or in commercial products that contain noisy components (motors, pumps, compressors, transmissions, transformers, ducts, etc.), including appliances, grinders, blenders, microwave ovens, sump pumps, etc.

Figure 1B:
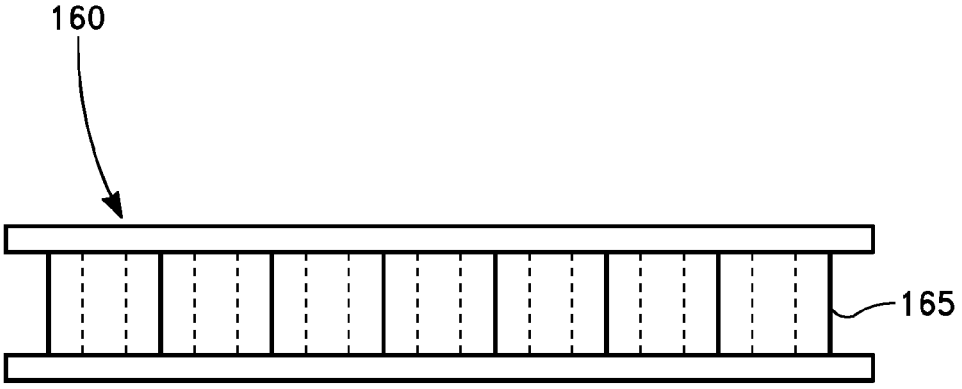
FIG. 1B shows a side view illustrating a possible core material constructions.
Figure 1C:
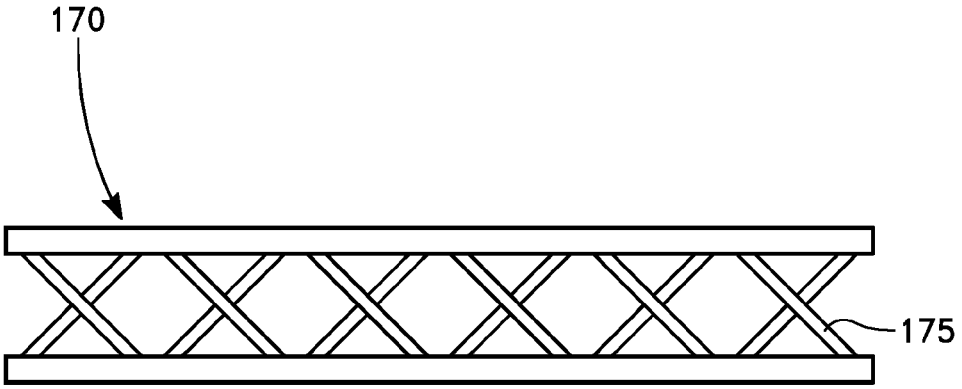
FIG. 1C shows a side view illustrating a possible core material constructions.

FIG. 1A is perspective view of a sandwich-structured acoustic barrier 100. FIGS. 1B and 1C are side views 160 and 170, respectively, illustrating two of many possible core material constructions. FIGS. 1A-C illustrate sandwich-structured acoustic composites 100, 160, and 170 with variable stiffness/mass which can isolate noise for low frequency applications. The sandwiched face sheets and core structure with designated stiffness and mass distribution creates an effective acoustic barrier to block noise based on the concepts of negative mass. The sandwich structure behaves as a vibration dipole with a nearly zero total volume displacement across the structure, and results in a weak acoustic radiation in the anti-resonance frequency range between principal resonances.

While previous membrane-type resonators can provide lightweight solutions for noise control, the challenges were found for some applications such as narrow band coverage at ultra-low frequencies (frequencies less than about 500 Hz) and damage or frequency shifting in harsh environment (high temperature variation). For sandwich-structured resonators, various embodiments take advantage of the system structure and the variable local stiffness and mass to efficiently tailor the vibration modal in large scale. In addition, the nature of high bending stiffness (no tension needed) with lightweight benefit and flexible manufacturing of sandwiched structure makes this sandwich-structured acoustic panel suitable to ultra-low frequency with large size design and harsh environment applications which compensate the current membrane-type designs.

The simplified illustration shown in FIG. 1A shows a sandwich-structured acoustic panel 100 with variable stiffness/mass, illustrated in areas 123, 125, and 127, capable of blocking incident sound waves, illustrated by arrow 105. The sandwich-structured composite 100 has face sheets 110 and 130, a central mass 112, and a core material/structure 120 to create vibration modes with low acoustic radiation 106 at designated noise frequencies. The central mass 112 and the sandwiched structure 150 with bending stiffness create a multiple degree of freedom mass-spring resonating system which blocks acoustic energy 105 at its anti-resonance frequencies, particularly between the first two odd principal resonances. FIGS. 1B and 1C show without limitation, some possible core material/structure configurations including honeycomb and truss/lattice structures 165 and 175 with variable stiffness/mass distribution throughout the panel. In addition to the honeycomb, foam, either open cell or closed cell, may be used for the core material. In addition, other cellular constructs, such as a box pattern, can be used. Acoustic performance may be enhanced with the open core materials (microlattice or honeycomb) through the introduction of porous absorption, either through fibrous batting or mats, or a light, open cellular material such as an open celled foam.

Figure 2A:
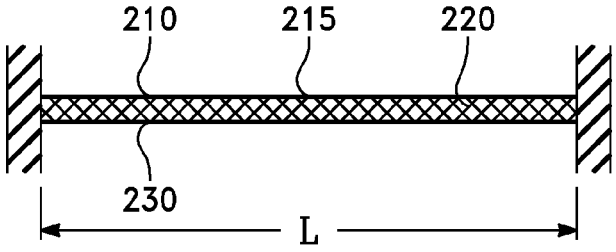
FIG. 2A shows a beam resonance model in accordance with one possible embodiment.
Figure 2B:
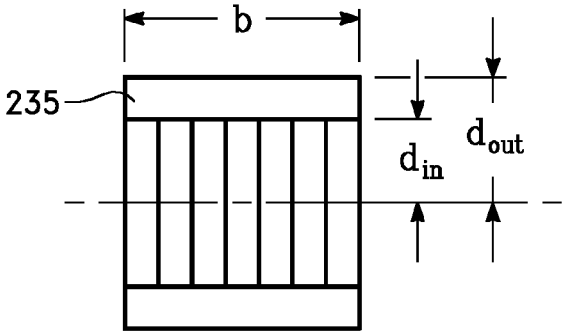
FIG. 2B shows an enlarged side view of a section the beam of FIG. 2A.
Figure 2C:
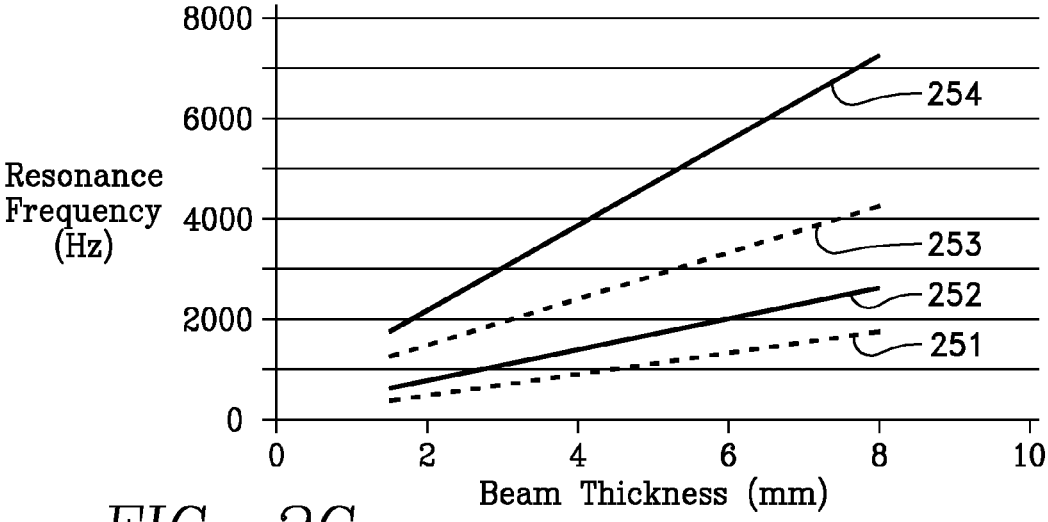
FIG. 2C is a graph of the predicted response of the beam resonance model of FIG. 2A.

FIGS. 2A-2C show the sandwiched structure layout and parametric estimation of non-tensioned system's resonance frequencies. A simplified sandwich beam 215 is shown in FIG. 2A. The beam 215 consists of uniform layers of face sheets 210 and 230 which are perfectly attached to the rigid core structure 220. FIG. 2B shows an enlarged section 235 of the beam 215 of FIG. 2A. In the equation, $$f_{res} \propto \frac{1}{L^2}\left(\frac{EI}{m}\right)^{0.5}$$

where $$I = \frac{2b}{3}(d_{out}^3 - d_{in}^3)$$

such that $$f_{res} \propto \frac{1}{L^2}\left(\frac{EI}{m}\right)^{0.5} \propto \frac{1}{L^{2.5}}\left(\frac{E(d_{0ut}^2 + d_{0ut}d_{in} + d_{in}^2)}{\rho}\right)^{0.5}$$

the resonance frequency $f_{res}$ is dominated by beam length L, the core depth $d_{in}$, and the thickness of face sheets, $d_{out}$-$d_{in}$. Basically, the first resonance increases with higher core and face sheet thickness, and decreases with larger panel size. Compared to a single sheet with the same weight, it is known that the sandwich-structured composites have significantly higher resonance frequencies due to the high bending stiffness. For resonator-type acoustic barriers, it is important for the structure to have high bending stiffness since a larger planar dimension or thinner panel can be implemented at the same target frequency without using structural tension.

FIG. 2C is a graph 250 of the predicted response of the laminated sandwich beam shown in FIG. 2A. The graph 250 shows a comparison of $1^{st}$ and $3^{rd}$ resonance frequencies as function of core thickness of a fixed-fixed beam 215. The solid lines 252 and 254 represent results of a sandwiched core composite beam with 0.4 mm thick Al face sheets. The dashed lines 251 and 253 represent the results of a solid Al beam. While the frequency and band width between $1^{st}$ and $3^{rd}$ modes increase as the beam thickness rises, the sandwiched core beam 215 has higher resonance frequencies and larger band width between $1^{st}$ and $3^{rd}$ modes.

In FIG. 2C, the resonance frequencies are compared between the sandwiched core composite and a solid beam with the same beam thickness. Although the solid beam definitely has higher bending stiffness than sandwiched core composite beam, the solid beam's weight counteracts its higher bending stiffness and makes the resonance frequencies even lower than the sandwiched core composite beam. With disadvantages of lower resonances and heavy weight; therefore, the solid beam becomes impractical for lightweight noise control applications. This lightweight and high bending stiffness characteristic makes the sandwich-structured panel a good acoustic barrier with scalable dimension at target frequencies of hundred hertz regime without using structural tension.

Figure 3:
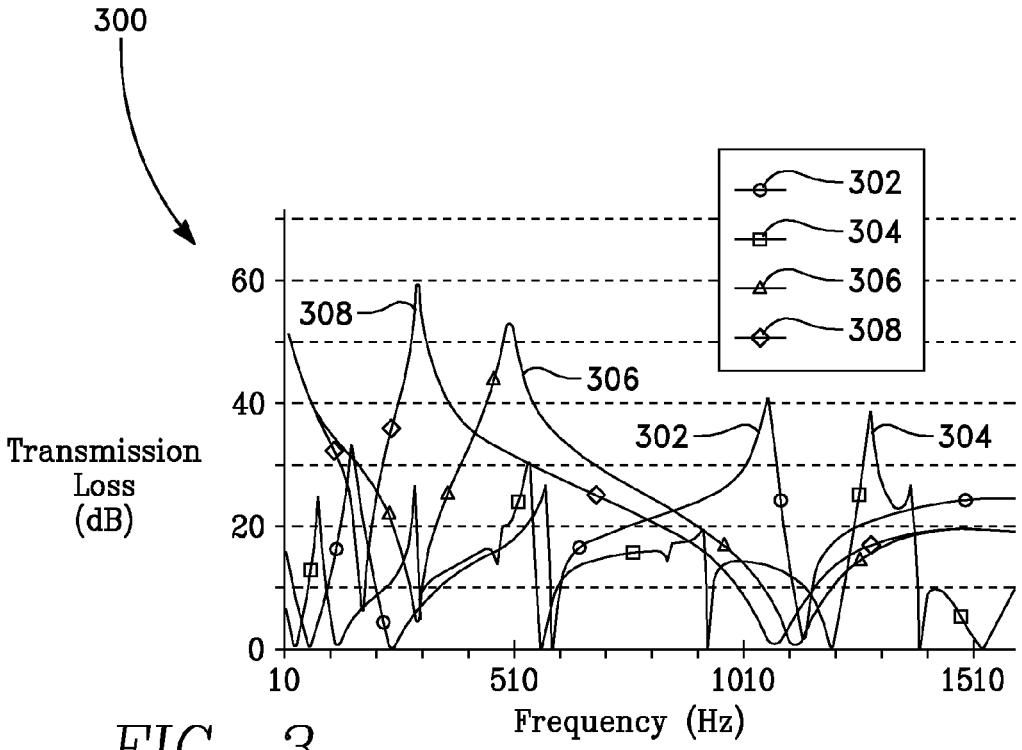
FIG. 3 shows a plot illustrating transmission loss simulation results of different panel configurations comparing basic variable stiffness and mass concepts.

FIG. 3 shows a plot 300 illustrating transmission loss simulation results of different panel configurations comparing basic variable stiffness and mass concepts. The panel size is 9.5 inch×9.5 inch and the 5 mm thick core structure is configured into concentric circles with spacing of 0.1 inch and modulus of 30 GPa. Represented in the graph 300 of FIG. 3 curve 302 is of a single 35.4 mils Al sheet embodiment; curve 304 is of a two separate 17.7 mils Al sheets embodiment; curve 306 is of a sandwiched core panel with two 17.7 mils thick Al face sheets and 40 g central mass embodiment; curve 308 is of a sandwiched core panel with two 17.7 mils thick Al face sheets and 100 g central mass embodiment.

FIG. 3 shows the transmission loss simulation results in the frequency spectrum of four examples to understand sandwiched composite's acoustic performance. Curve 302 shows the transmission loss of a single 0.9 mm thick Al sheet. In this curve, the $1^{st}$ and $3^{rd}$ resonances are at 60 Hz and 250 Hz while the anti-resonance peaks at 150 Hz with medium transmission loss and narrow bandwidth. If the 35.4 mils thick sheet is split into two 17.7 mils thick sheets without a core material, as shown in the curve 304, both resonances decrease and low transmission loss and narrower bandwidth is observed. However, as shown in the curve 306, a significant increase of resonance frequencies, transmission loss amplitude, and bandwidth can be obtained when a lightweight core material is sandwiched between 17.7 mils face sheets with a 40 g central tile mass. This result theoretically indicates that the concept of non-tensioned sandwich-structured acoustic barriers possess high bending stiffness, lightweight/compact advantages and good noise control capability. Adding additional mass to the center, as described and shown for curve 308, pushes the $1^{st}$ resonance downward while having similar $3^{rd}$ resonance broadens the effective bandwidth.

Figure 4:
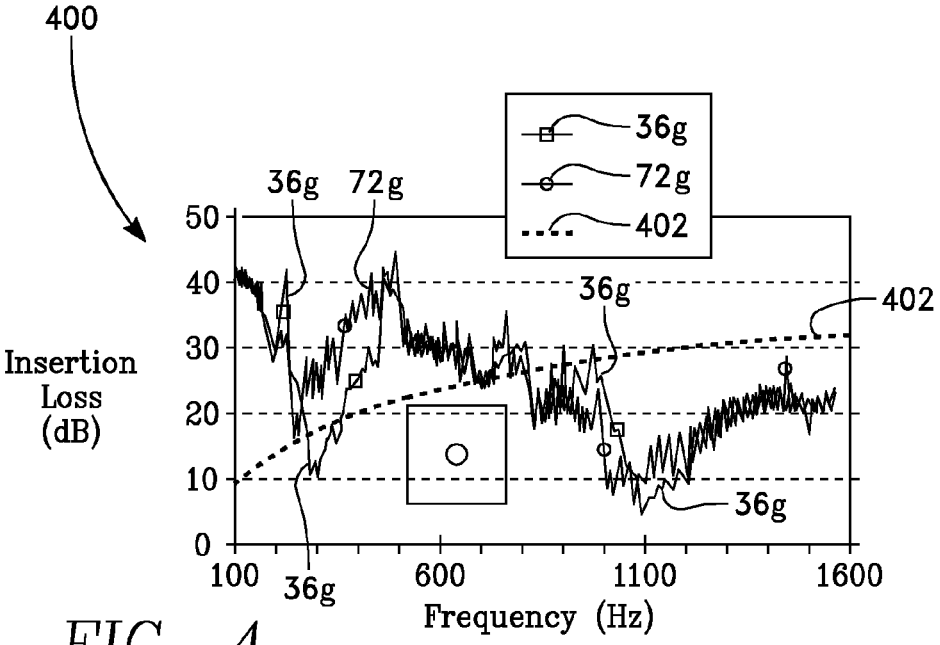
FIG. 4 shows a graph of the insertion loss measurements for a sandwich-structured acoustic panel and its mass law prediction.

FIG. 4 shows a graph 400 of insertion loss measurements for a sandwich-structured acoustic panel (10"×10"×0.16" Al honeycomb panel with 36 gram and 72 gram panel central mass; stiffness not optimized). Compared insertion loss measurement of 36 gram attached mass panel with its mass law prediction curve 402 (dashed), the panel has better insertion loss with 400 Hz band width centered at 550 Hz and 20 dB noise reduction at 500 Hz than the mass law prediction.

The 10 inch×10 inch×0.16 inch sandwiched panel comprises of two identical 15 mils thick Al face sheets, a 0.125 inch thick Al honeycomb, and a 36 gram or 72 gram central mass. The bending stiffness and mass distribution is uniform throughout the panel in this sample and different weight was attached at panel center to study the panel dynamics and related acoustic performance. The 36 g curve shows a dip around 400 Hz and peaks at 510 Hz with a gradual decrease until reaches another dip at 1100 Hz. The dips at 400 Hz and 1100 Hz are the 1st (0,1) and $3^{rd}$ (0,3) resonances where the acoustic energy transmits efficiently through the panel. At the curve peak around 510 Hz, the insertion loss reaches 45 dB which is more than 20 dB higher compared to the mass law prediction curve 402 (dashed curve—mass law with 36 grams added mass). By adding more central weight to the panel, the 72 grams curve shows a downward $1^{st}$ resonance shifting and steady $3^{rd}$ resonance which results in broader band width and low frequency noise reduction. This result shows clear evidence how variable mass approach tunes the panel acoustic performance. Since traditional resonators always have narrow band coverage at low frequency noise control, the wide band coverage in this example provides a promising solution for low frequency noise control. With other available design parameters such as panel size, central mass arrangement, global/local core stiffness, global/local face sheet thickness, and curvature of panel, a lightweight, compact, robust, and non-tensioned sandwich-structured acoustic panel can be designed for specific noise control applications. The following paragraphs detail the design parameter trade space.

Figure 5A:
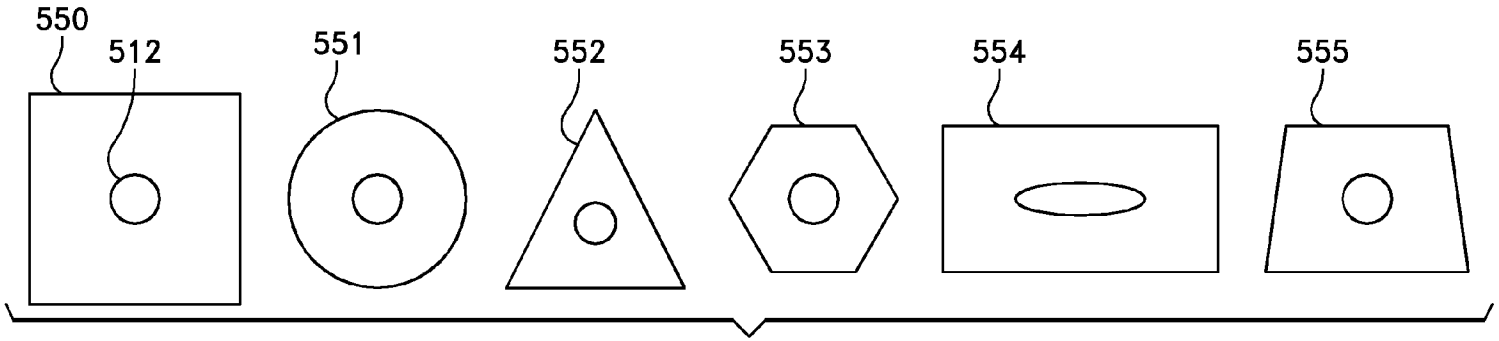
FIG. 5A shows schematic top views of various panel shapes for the sandwich-structured panel.
Figure 5B:
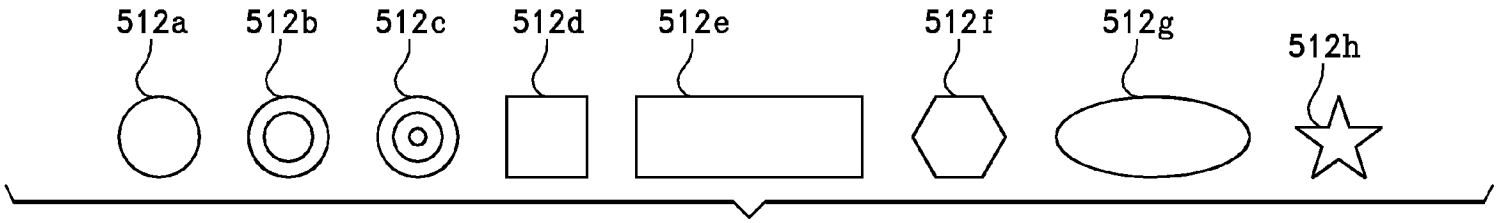
FIG. 5B illustrates top views of various central mass shapes.
Figure 5C:
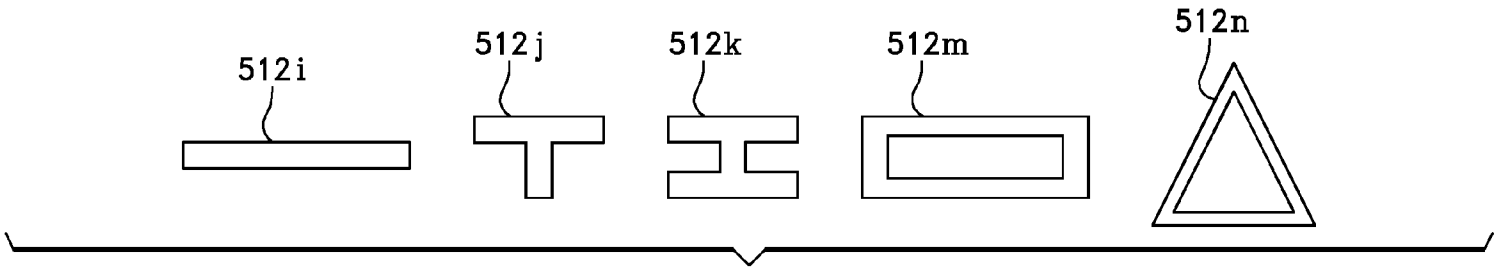
FIG. 5C illustrates cross sectional side views of various central mass shapes.

FIG. 5A shows different possible shapes of sandwich-structured acoustic panels and central mass configurations. FIG. 5A shows a square shape sandwich panel 550 with a central mass 512. The central mass 512 design may include any of the shapes, such as but not limited to circular 512*a*, annular 512*b*, bulls eye 512*c* (combined circular and annular), square 512*d*, rectangular 512*e*, hexagonal 512*f*, elliptical 512*g*, or star 512*h*, such as illustrated in FIG. 5B, and any of the cross sections, such as but not limited to rectangular 512*i*, "T" shape 512*j*, "I" shape 512*k*, hollow rectangular 512*m*, triangular 512*n*, as shown in FIG. 5C. The mass 512 attachment may be, but is not necessarily on the panel surface; it could be integrated inside the panel with the core materials/structures to retain a thin profile and for aesthetics. The number of masses is also not limited to a single unit; it could be a mass array on designated area.

There are two main purposes to use different shaped weights: 1. Define effective panel bending length or compensate panel's irregular shape to control mode shapes and obtain required acoustic performance. 2. Multiple weights for different target frequencies such as concentric circles. As for the cross section of mass, shapes such as I, T, or hollowed geometries can be selected to design thin or slender central weight while maintain rigidity.

In the mass-spring system, the mass/weight decreases the $1^{st}$ resonance but has little influence on $2^{nd}$ resonance. The size of the mass determines the effective panel length for $1^{st}$ & $3^{rd}$ mode shape. A larger mass size occupies more panel area and shortens the effective panel length for $1^{st}$ and $3^{rd}$ mode resonances. This slightly raises the $1^{st}$ mode resonance frequency and significantly increases the $3^{rd}$ mode resonance frequency which broadens the noise reduction bandwidth.

In FIG. 5A, also shown are schematic top views of other possible embodiments of the panel shape. Shown are circular 551, triangular 552, hexagonal 553, rectangular 554, and trapezoidal 555 panel shapes.

Embodiments are not limited to these shapes or cross sections, other shapes or cross sections are possible. The selection of panel shape depends on the geometrical shape of different applications.

The central mass structure may be attached to at least one of the face sheets, either outside the sandwich structure, or in between the face sheets, or both. At least one of the geometry or dimension being configured to provide shorter effective length of resonances such that the sandwich structure resonators provide high resonance frequency responses and broadband coverage.

FIGS. 6A-6D are a schematic top views showing potential variations in local variable stiffness and mass distributions of sandwich-structured acoustic panels. As discussed in previous sections, the sandwiched core structure has significantly higher resonances than a beam with the same weight or the same thickness due to its high bending stiffness/weight ratio. However, as a resonator-type acoustic barrier, it is important to control other individual modes for wider noise reduction bandwidth and higher transmission loss magnitude. As such, various embodiments make use of planar mode control through the targeted application and design of local stiffness and mass variations.

Figure 6A:
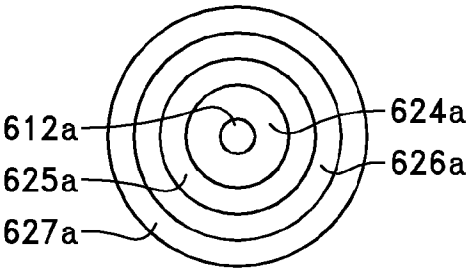
FIGS. 6A-D are schematic top views of various embodiments of sandwich-structured panels showing potential variations in local variable stiffness and mass distributions of the sandwich-structured acoustic panels.
Figure 6B:
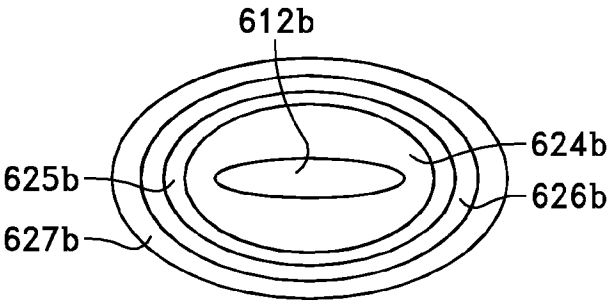

In FIG. 6A, the top view schematic shows the basic concept of local property design to control the $1^{st}$ and $3^{rd}$ vibration modes. There are three areas: weighted area 612*a*, stiffened areas 625*a* and 627*a*, and reduced mass areas 624*a* and 626*a*; and each can be achieved by designing non-uniform core materials and tailored stiffness face sheet layouts. Previous studies on membranes indicated that adding central weights could decrease the $1^{st}$ mode without changing the $3^{rd}$ mode frequency which broadens the bandwidth between these two modes. Further, larger weighted area will shorten the effective panel bending length of $3^{rd}$ mode resonance, which correspondingly raises the $3^{rd}$ mode resonance frequency.

In practice, high bending stiffness of sandwich panels relies on the interaction of both a rigid core structure and axially stiff face sheets to carry the applied loads. A soft core material experiences a shear deformation, particularly at the nodes of the panel's vibration modes. By enhancing core's shear strength with high strength face sheets in node areas 625*a* and 627*a* as shown in the FIG. 6A, the $3^{rd}$ mode resonance can be increased which broadens the bandwidth. FIG. 6A shows a face sheet 610*a* stiffened in concentric annular ring shaped areas 625*a* and 627*a*.

Figure 6C:
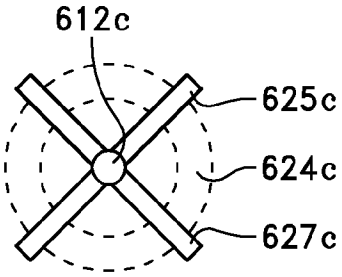
Figure 6D:
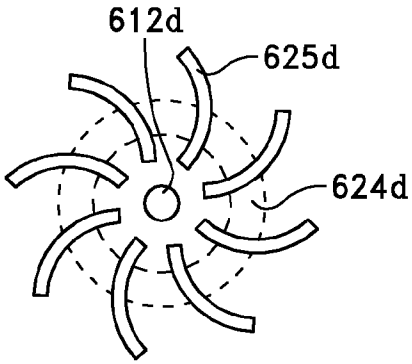

Finally, reducing the weight or mass at the anti-node of the mode as shown in FIG. 6A by reduced mass areas 624*a* and 626*a*, the $3^{rd}$ mode resonance frequency can be increased. This local stiffness and mass distribution will vary depending on the panel shape and configuration, such as FIG. 6B for a rectangular panel with an elliptical weighted area 612*b*, elliptical stiffened areas 625*b* and 627*b*, and elliptical reduced mass areas 624*b* and 626*b*; but, the essential mechanism and targeted vibration behavior remains the same. In FIG. 6C and (d) are two local stiffness and mass designs which will raise $3^{rd}$ resonance and serve to broaden the effective bandwidth of acoustic attenuation. Shown in FIG. 6C are weighted area 612*c*, generally straight segment shaped stiffened areas 625*c* and 627*c*, and reduced mass areas 624*c*. Shown in FIG. 6D are weighted area 612*d*, outwardly extending curved shaped stiffened areas 625*d* and 627*d*, and reduced mass areas 624*d*.

Figure 7A:
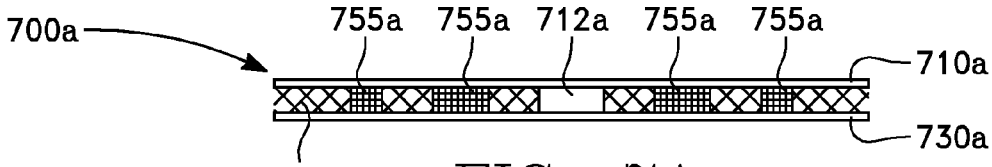
FIG. 7A shows a cut away side view of sandwich-structured panels illustrating distributed core strength.
Figure 7B:
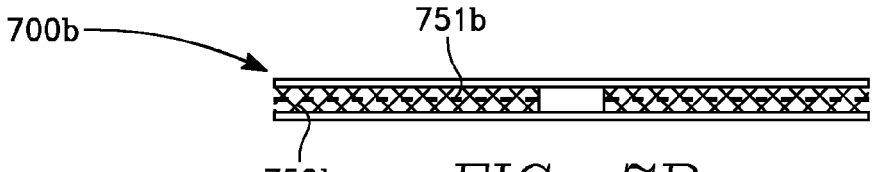
FIG. 7B shows a cut away side view of sandwich-structured panels illustrating an intermediate stiffening layer within the core.
Figure 7C:
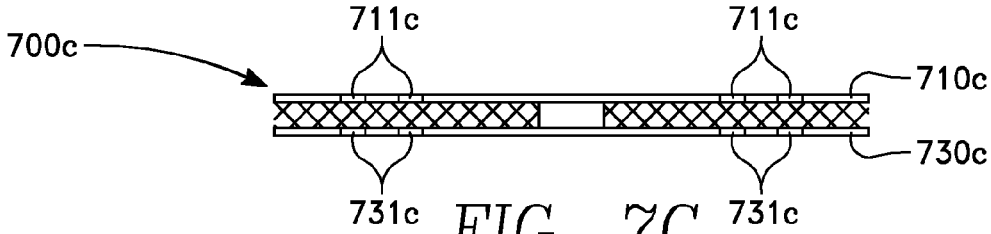
FIG. 7C shows a cut away side view of sandwich-structured panels illustrating local enhanced face sheets.
Figure 7D:
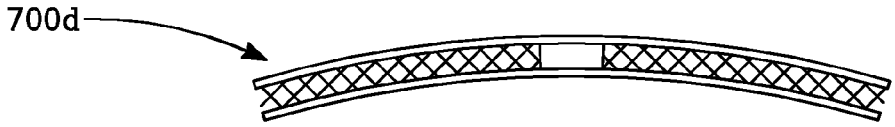
FIG. 7D shows a cut away side view of sandwich-structured panels illustrating a curved panel.
Figure 7E:
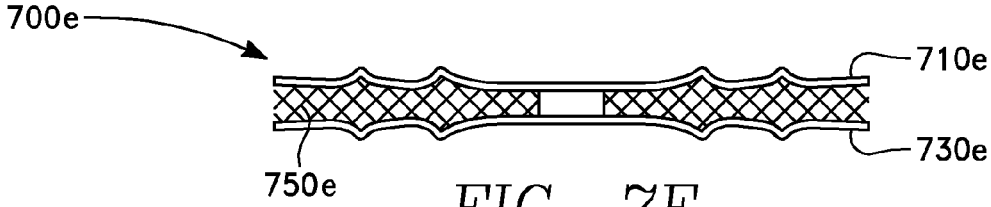
FIG. 7E shows a cut away side view of sandwich-structured panels illustrating a non-uniform thickness panel.

FIGS. 7A-7E show cut away side views of sandwich-structured panels with a variable stiffness and its configurations. Conventionally, the bending stiffness (as resonant frequencies) of a sandwich panel is altered through changing the core thickness. In FIGS. 7A-7E, shown are embodiments that can tune the stiffness spatially to better control the vibration modes and subsequently the acoustic radiation. FIG. 7A is an embodiment 700*a* that shows local stiffness control through core structure 750*a* design. A central mass 712*a* is attached to the face sheets 710*a* and 730*c*. A core 750*a* with locally strengthened core portions 755*a* to provide distributed core strength. FIG. 7B is the embodiment 700*b* having an intermediate stiffening layer 751*b*, which enhances the shear modulus of core materials 750*b*. As mentioned previously, the shear modulus determines the bending stiffness of the panel. This approach improves the shear modulus and increases the global/local stiffness which could increase resonance frequency of all resonances or specific mode to create broad bandwidth. FIG. 7C is an embodiment 700*c* that shows the local stiffness control of face sheets 710*c* and 730*c*. The face sheets 710*c* and 730*c* are locally enhanced by enhanced areas 711*c* and 713*c*. The sheet 710*c* or 730*c* thickness and the locally enhanced techniques, such as incorporated fiber composites, can be designed to tune the local stiffness. FIG. 7D is an embodiment 700*d* that shows the curved panel design, which addresses the applications with curved profiles. The curved structures also exhibit higher resonances than straight plates which benefits the compact panel design and higher frequency applications. FIG. 7E discloses the non-uniform panel sandwiched panel design 700*e*. By varying the local panel 700*e* thickness with sandwiched core materials 750*e*, the local stiffness can be significantly changed. The panel 700*e* thickness is determined by face sheet 710*e* and 730*e* profiles, which can be molded or embossed into the desired geometry. In FIG. 7E, the face sheets are non-planar with opposing face sheets 710*e* and 730*e* are symmetrical with respect to a plane extending between the face sheets 710*e* and 730*e*.

As depicted in FIG. 7A, the variable core structure 750*a* can be fabricated, for example, using the truss/lattice process as disclosed in U.S. Pat. No. 7,382,959, entitled OPTICALLY ORIENTED THREE-DIMENSIONAL POLYMER MICROSTRUCTURES by Alan J. Jacobsen, issued Jun. 3, 2008, herein incorporated by reference in its entirety. With this scalable process, different designs such as truss orientation, size, and density are possible within a single, continuous core material, the shear modulus can be locally varied by tuning the cellular architecture of the micro-truss core as described below.

Figure 8:
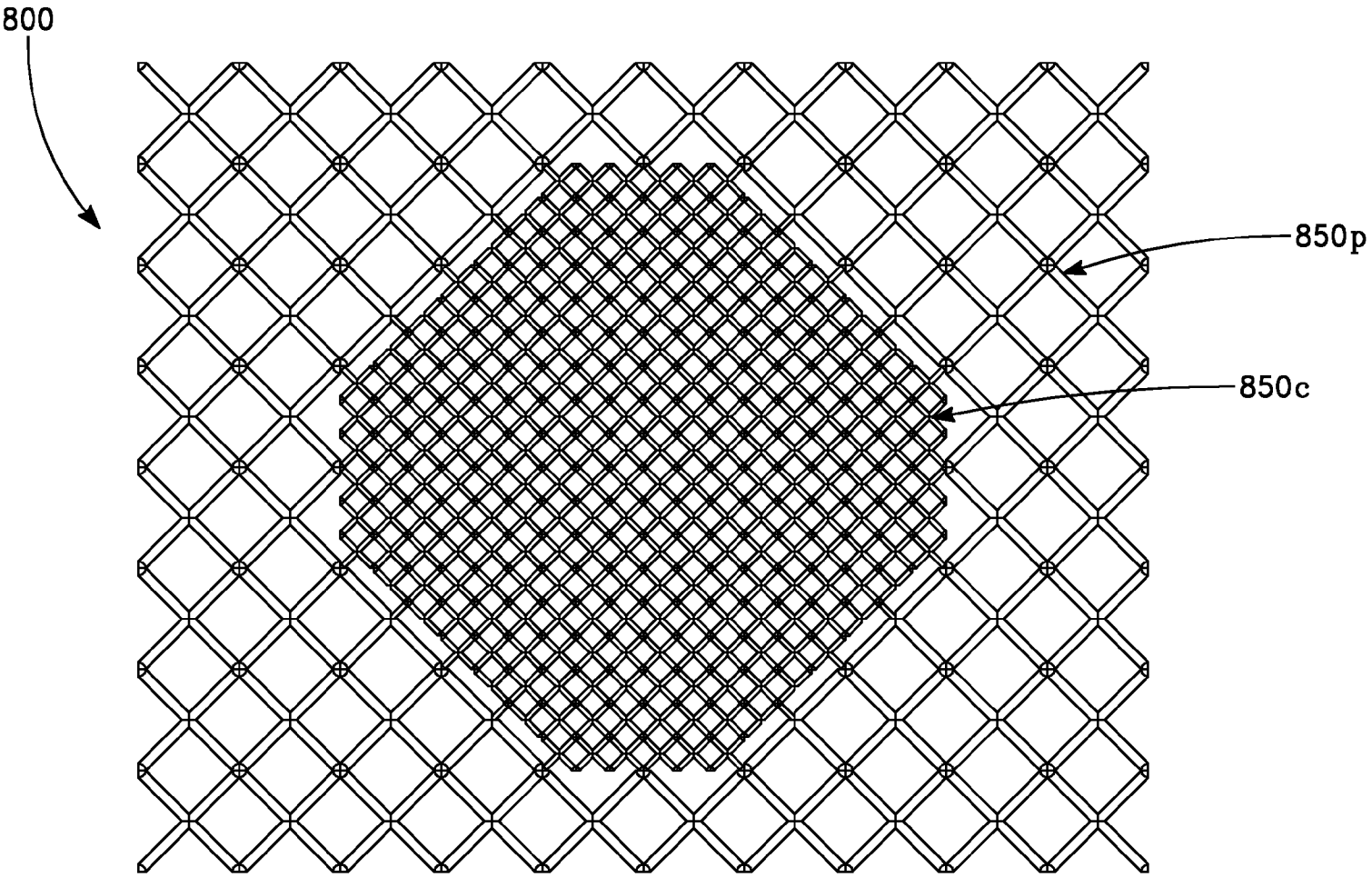
FIG. 8 is a photograph of a micro-truss structure with two distinct cellular architectures that have different properties.

The shear modulus of a micro-truss core material with octahedral-type architecture can be estimated using the following equation:

$$G \approx \frac{E}{8}\left(\frac{\rho}{\rho_s}\right)\sin^2 2\theta$$

where $(\rho/\rho_s)$ is the relative density of the structure defined by, $$\frac{\rho}{\rho_s} = \frac{2\pi r^2}{l^2\cos^2\theta\sin\theta}$$

and the variables r, l, and θ represent the individual truss member radius, length, and angle, respectively. The radius (r) and the length (l) can be individually tuned within the truss to locally vary the shear modulus, and hence the panel stiffness. FIG. 8 is an example of a micro-truss structure with two different architectures (and local shear moduli) in a single continuous material. As shown in FIG. 8, one embodiment the microtruss structure can be formed of a plurality of ordered polymer microtruss members integrally connected at nodes. The microtruss members extend from a node in different directions, typically extending from a node with a non-perpendicular angle with at least one other microtruss member. Shown in FIG. 8, the microtruss members near a center portion 850*c* of the lattice are more closely spaced than the peripheral microtruss members 850*p* surrounding the central portion 850*c*, so which form a less dense lattice structure 850*p*.

Figure 7F:
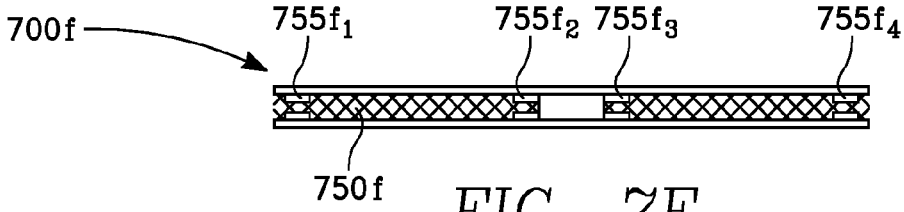
FIG. 7F shows a cut away side view of sandwich-structured panels illustrating portions of the core removed.

Another approach to generate local areas of core stiffness is to machine or etch the core such that during sandwich panel fabrication, areas of the core are not contacted or adhered to the facesheets. FIG. 7F shows a cut away side view of sandwich-structured panel 700*f* illustrating a core 750*f* that has portions 755*$f_1$*, 755*$f_2$*, 755*$f_3$*, and 755*$f_4$* removed, such as by etching, machining, or the like. The locally removed portions 755*$f_1$*, 755*$f_2$*, 755*$f_3$*, and 755*$f_4$* will reduce the load transfer locally and affect the stiffness and resonant frequencies of particular modes.

Figure 9A:
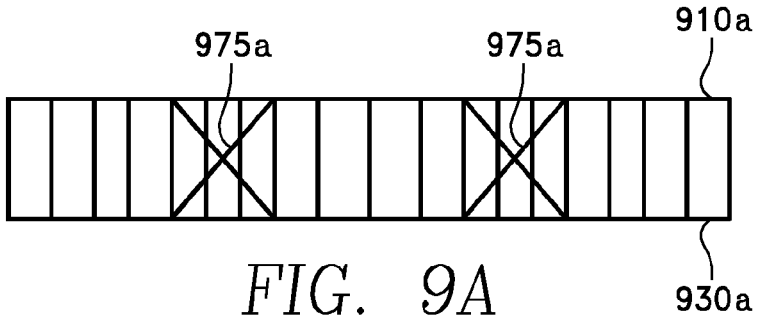
FIGS. 9A-E are cut away side views depicting possible architectures that enable variable stiffness in a sandwich panel.

Further, additive manufacturing methods including selective laser sintering, selective electron beam melting and stereo lithography, as well as the truss/lattice process disclosed in the above referenced U.S. Pat. No. 7,382,959 can be used to create a variety of structures with variable stiffness. Location specific stiffness can be achieved by adding reinforcements in certain locations, for example additional diagonal connections 975*a* between the two face sheets 910*a* and 930*a* results in higher shear stiffness (FIG. 9A). FIGS. 9A-9E are cut away side views depicting possible architectures that enable variable stiffness in a sandwich panel.

Figure 9B:
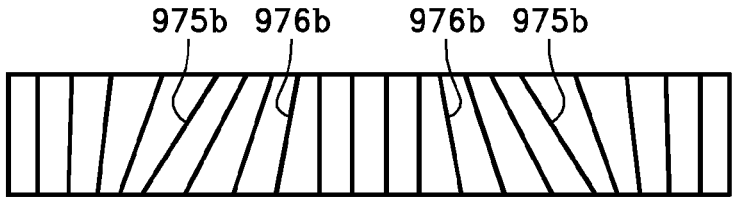
Figure 9C:
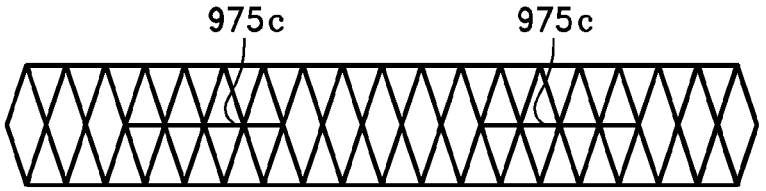
Figure 9D:
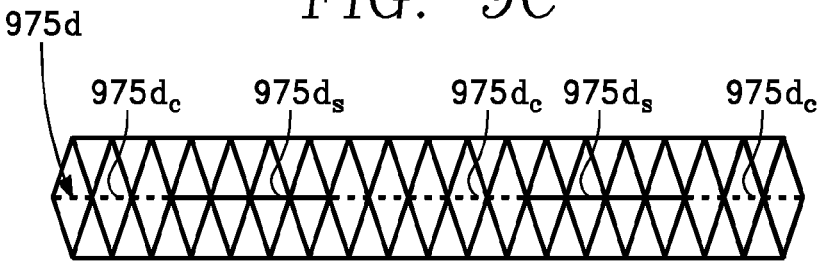
Figure 9E:
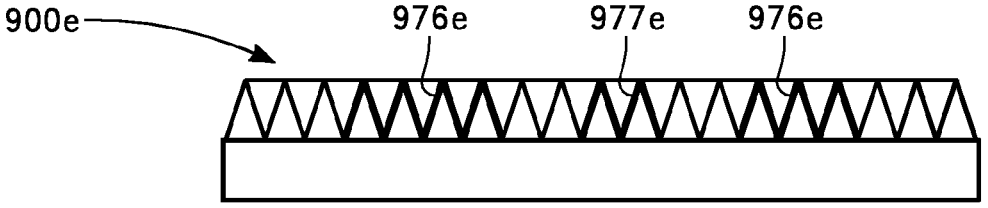

As described in FIG. 7B, shear modulus determines panel's bending stiffness, i.e. higher bending stiffness requires high shear modulus of the core material/structure. With the configurations shown in FIGS. 9B-9E, the shear stiffness can be varied independent of the mass by varying the angles of the interconnections between the two face sheets. As shown in FIG. 9B, an angle closer to 45° (for trusses 975*b*) results in higher shear stiffness than an angle closer to 90° (for trusses 976*b*). Another way to increase shear stiffness is to add horizontal reinforcements 975*c* (FIG. 9C). As shown in FIG. 9C, this can be achieved by inserting machined sheets 975*c* when assembling the sandwich panel from 2 cores and 2 face sheets. With this approach, ring shaped or other sheets 975*c* can be inserted as shown in FIG. 9C. Different patterns of different materials 975*d* could also be employed where stiff materials 975*$d_s$* could be used to enhance stiffness and compliant materials 97*$d_c$* (polymers, rubber) could be used to lower stiffness (FIG. 9D). FIG. 9E shows a preferred embodiment of a micro-truss half layer structure 900*e* that provides excellent shear stiffness, which can be varied easily by altering the diameter of trusses 976*e* and 977*e* locally.

Based on the flexible core material/structure control, such as the microtruss structures disclosed in the above referenced U.S. Pat. No. 7,382,959, a local stiffness and mass can be modified to address various applications. All embodiments described above can be used alone or combined to achieve the best performance for specific requirements.

Figure 10A:
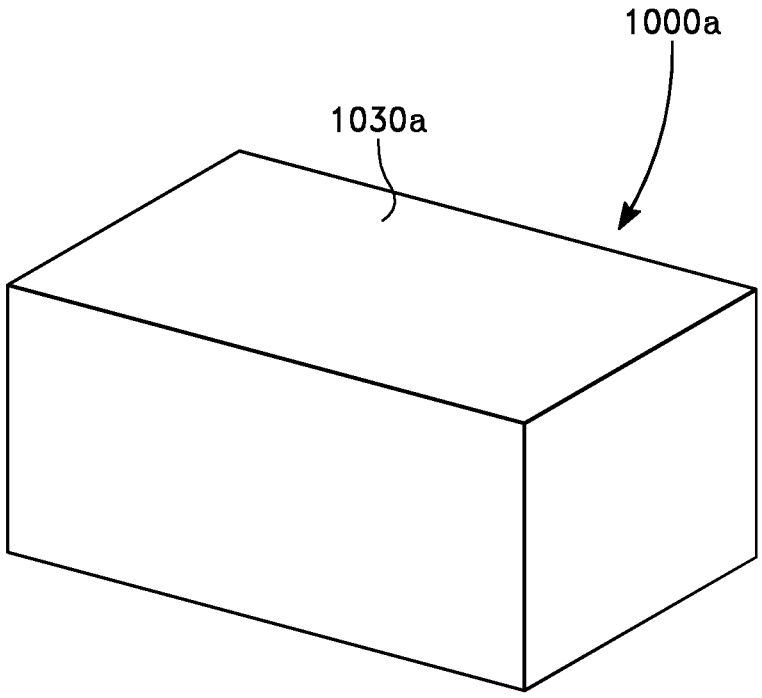
FIGS. 10A-B show perspective views of three-dimensional structure composed of sandwich-structured composites with variable stiffness/mass.
Figure 10B:
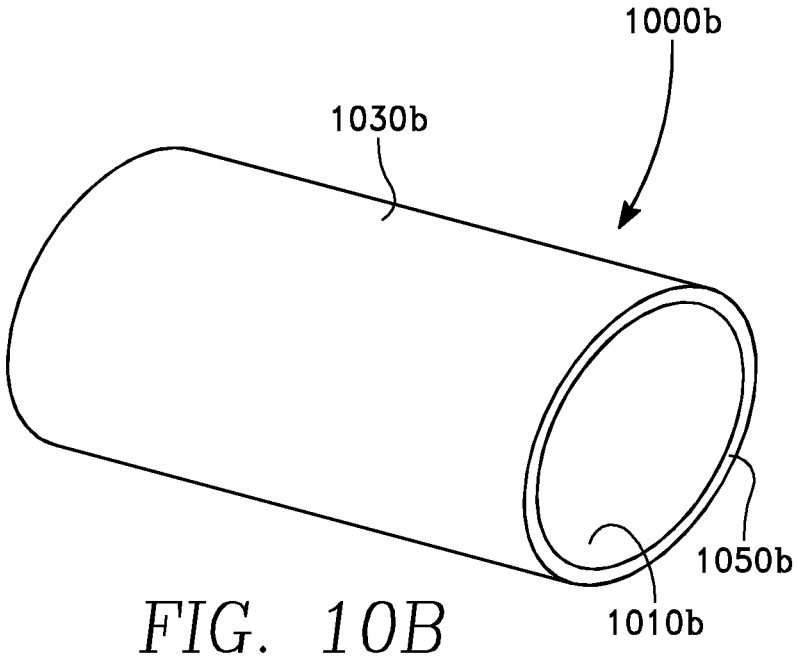

FIG. 10A-10B show perspective views of the three-dimensional structures or enclosures 1000*a* and 1000*b* having sandwich-structured acoustic barriers. The enclosures 1000*a* and 1000*b* are typically hollow enclosure structures that may be partial or full enclosures 1000*a* and 1000*b*. The rectangular enclosure 1000*a* has interior face sheets (not shown) and exterior face sheet(s) 1030*a*, with a core (not shown) between the interior and exterior face sheets. The cylindrical enclosure 1000*b* has an interior face sheet 1010*b*, and an exterior face sheet 1030*a*, with a core 1050*b* between the interior and exterior face sheets 1010*a* and 1030*b*. Mechanical and electrical equipment can emit objectionable tones due to operation that must be shielded and dissipated to isolate the equipment from its environment. Depending on the enclosed sound emitting components/machines and principal emission frequencies, the panel or panels can be designed/configured according to the dimension and noise control requirements.

As shown in FIG. 10B, the sandwiched panel 1000*b* can be fabricated into a cylindrical configuration with a distributed weight array. With the circumferential nodal and axial nodal patterns 1100*b* and 1100*a*, respectively, shown in FIGS. 11A-11C, the cylindrical structure can be designed into lightweight acoustic barriers for different applications.

In addition, there are several material options to construct the tunable sandwich-structured acoustic barriers. The resonator can be transparent if transparent materials such as glass or transparent plastic are used. In the enclosure with heat-generated component, thermal conductivity of the face sheets and core materials is important to dissipate the extra heat. When using a microtruss core, it may be advantageous to combine the sandwich panel treatment with a force flow fluid heat extraction turning the acoustic treatment into a cold plate heat removal system. For the thermal insulation required applications, such as commercial aircraft cabin or helicopter fuselage, heat insulating materials can be used for face sheets and core structures and coated with reflected layer to reflect back the heat energy. Because of the high stiffness nature, the sandwiched core panel can be used to build blast protection case.

Figure 11A:
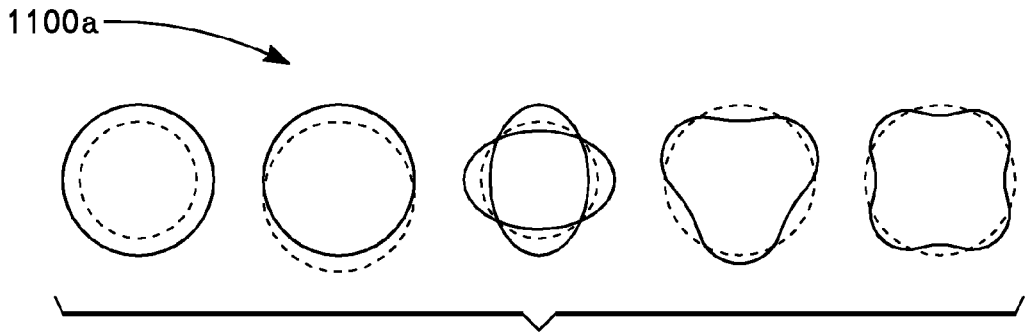
FIGS. 11A-C illustrate the circumferential nodal and axial nodal patterns for a cylindrical sandwich structured acoustic barrier.
Figure 11B:
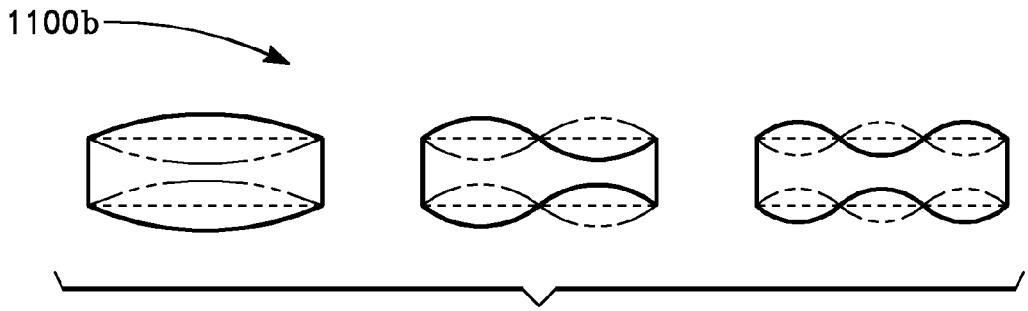
Figure 11C:
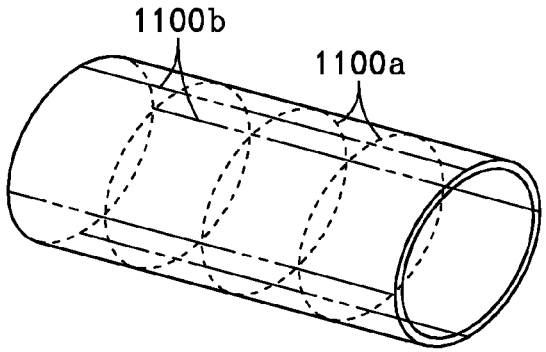

FIGS. 11A-11C illustrate possible circumferential nodal and axial nodal patterns 1100*b* and 1100*a*, respectively. FIG. 11C shows a perspective view of a cylindrical sandwich structured acoustic barrier with variable stiffness showing the circumferential and axial nodes 1100*b* and 1100*a*, respectively. FIG. 11A illustrates the circumferential node patterns 1100*a* for n=0 to n=4. FIG. 11C illustrates the circumferential node patterns 1100*b* for m=0 to m=3.

In various embodiments, a sound attenuating panel may be created using a sandwich panel construction with spatially varying distributions of stiffness and concentrated masses.

In some embodiments, the face sheets may be spatially tailored to control its stiffness and create a single pair of interacting vibrations modes. In some embodiments, the face sheets may be formed of flat sheets, curved sheets, or conformal sheets. In some embodiments, the face sheets may be formed of sheets with varying thickness to tailor local stiffness and mass. In some embodiments, the face sheets may be formed of sheets with local enhanced woven and knitting fiber composite. In some embodiments, the face sheets are made of metal, polymer, ceramic, fiber-enhanced composite and paper based materials.

In some embodiments, the core material/structure may be spatially tailored to control its stiffness and create a single pair of interacting vibrations modes. In some embodiments, the spatially tailored core is formed of a microlattice layer. In some embodiments, the spatially tailored core is formed of a honeycomb or other repeating cellular structure. In some embodiments, the shear modulus of the core material is tailored and enhanced to improve panel bending stiffness with a central stiffening layer. In some embodiments, the spatially tailored core is made of metal, polymer, ceramic, fiber-enhanced composite, and paper based materials. In some embodiments, the core material is composed of a closed or open cell cellular material such as foam that is either uniform or altered in stiffness or density through the assembly of pieces of different density foams. In some embodiments, the micro-lattice or honeycomb core is enhanced with the addition of a fabric or porous absorber to dampen cavity mode acoustic energy. In some embodiments, the micro-lattice or honeycomb core is enhanced with the structure absorber to dissipate acoustic energy. In some embodiments, the honeycomb core is machined so that regions of the core do not touch and transfer load into the face sheet In some embodiments, the panel shape comprises at least one of rectangular, square, triangle, polygons, circular, or irregular. The attached mass may be external, or integrated into the core material. The attached mass may comprise circular, oval, rectangular shapes, solid or hollow 3D shapes, or have a stepped profile to extend the free length of the sandwich panel.

Various embodiments, of the tailored stiffness panel may be used to create an enclosure to contain emission from equipment or machinery. For example, various embodiments by be formed into a cylindrical shape to contain emission from equipment or machinery.

It is also possible, in accordance with the teachings above, to also have a variable local damping across the sandwich-structured acoustic panel. For example, the core material itself may provide some damping for the sandwich-structure panel. It is possible to use different materials in the core to vary the damping across the sandwich-structured acoustic panel.

In one embodiment, a sound attenuating barrier is provided having a core structure between face sheets with a mass structure attached to at least one face sheet, with the core/and or face sheet(s) being constructed to design an effective vibration length, as well as enable a variable local stiffness and mass across the sound attenuating barrier such that the sandwich structure attenuators provide variable resonance frequency responses and broadband coverage.

In general, a heavier central mass weight provides decreased $1^{st}$ resonance. Further, a larger central mass provides some increased $1^{st}$ mode resonance, but it especially $3^{rd}$ mode resonance. A thicker core provides an increase all frequencies. Local core thickness, core strength, facesheets, and cutaways affect the local stiffness, while local core density and face sheets affect the local density.

The mass geometry and size is one of the key points to increase the resonance frequencies and bandwidth. For example, the central mass with larger diameter increases resonance frequencies, which are important to targeting certain application frequencies and broadening the bandwidth for panels with a larger dimensions.

As used herein a "barrier" can partially or completely attenuate sound.

It is worthy to note that any reference to "one embodiment/implementation" or "an embodiment/implementation" means that a particular feature, structure, action, or characteristic described in connection with the embodiment/implementation may be included in an embodiment/implementation, if desired. The appearances of the phrase "in one embodiment/implementation" in various places in the specification are not necessarily all referring to the same embodiment/implementation.

The illustrations and examples provided herein are for explanatory purposes and are not intended to limit the scope of the appended claims. This disclosure is to be considered an exemplification of the principles of the invention and is not intended to limit the spirit and scope of the invention and/or claims of the embodiment illustrated.

Those skilled in the art will make modifications to the invention for particular applications of the invention.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or member can actually be representative or equivalent members. Again, these are implicitly included in this disclosure. Where the invention is described in device-oriented terminology, each member of the device implicitly performs a function. It should also be understood that a variety of changes may be made without departing from the essence of the invention. Such changes are also implicitly included in the description. These changes still fall within the scope of this invention.

Further, each of the various members of the invention and claims may also be achieved in a variety of manners. This disclosure should be understood to encompass each such variation, be it a variation of any apparatus embodiment, a method embodiment, or even merely a variation of any member of these. Particularly, it should be understood that as the disclosure relates to members of the invention, the words for each member may be expressed by equivalent apparatus terms even if only the function or result is the same. Such equivalent, broader, or even more generic terms should be considered to be encompassed in the description of each member or action. Such terms can be substituted where desired to make explicit the implicitly broad coverage to which this invention is entitled. It should be understood that all actions may be expressed as a means for taking that action or as a member which causes that action. Similarly, each physical member disclosed should be understood to encompass a disclosure of the action which that physical member facilitates. Such changes and alternative terms are to be understood to be explicitly included in the description.

While the present invention has been described in connection with certain exemplary embodiments, it is to be understood that the invention is not limited to the disclosed embodiments; on the contrary, it is intended to cover various modifications and equivalent arrangements included within the spirit and scope of the appended claims, and equivalents thereof.

What is claimed is:

1. A sound attenuating barrier comprising:

a) face sheets;

b) a core structure between the face sheets;

c) a mass structure attached to at least one of the face sheets; and d) the sound attenuating barrier further comprising at least one of: (1) a spatially varied stiffness distribution; or (2) a spatially varied density across the sound attenuation barrier.

2. The sound attenuating barrier of claim 1, wherein at least one face sheet comprises a non-planar face sheet.

3. The sound attenuating barrier of claim 1, wherein at least one of the face sheets is a curved face sheet.

4. The sound attenuating barrier of claim 1, wherein the sound attenuating barrier comprises a three dimensional enclosure.

5. The sound attenuating barrier of claim 1, wherein the at least one of: (a) the variable local stiffness across the sound attenuating barrier; or (b) the variable density across the sound attenuating barrier is configured such that a single pair of interacting vibration modes are created in response to incident sound within a desired frequency range.

6. The sound attenuating barrier of claim 1, wherein at least one face sheet comprises: (a) a spatially varied stiffness distribution; or (b) a spatially varied mass distribution.

7. The sound attenuating barrier of claim 6, wherein the at least one face sheet comprises stiffed areas configured so as to broaden a bandwidth by increasing the third mode resonance.

8. The sound attenuating barrier of claim 7, wherein the at least one face sheet further comprises at least one reduced mass area configured so as to broaden a bandwidth by increasing the third mode resonance.

9. The sound attenuating barrier of claim 6, wherein the at least one face sheet comprises reduced mass areas configured so as to broaden a bandwidth by increasing the third mode resonance.

10. The sound attenuating barrier of claim 6, wherein the at least one face sheet comprises a plurality of generally linear stiffener regions.

11. The sound attenuating barrier of claim 6, wherein the at least one face sheet comprises a plurality of generally curved stiffener regions.

12. The sound attenuating barrier of claim 6, wherein at least one face sheets comprises at least one stiffened annular region.

13. The sound attenuating barrier of claim 12, wherein the at least one stiffened annular region is ellipse shaped.

14. The sound attenuating barrier of claim 12, wherein the at least one face sheet further comprises at least one reduced mass annular region.

15. The sound attenuating barrier of claim 6, wherein the at least one face sheet comprises at least one reduced mass annular region.

16. The sound attenuating barrier of claim 6, wherein the core structure comprises at least one of: (a) a spatially varied stiffness distribution; or (b) a spatially varied mass distribution.

17. The sound attenuating barrier of claim 1, wherein the core structure comprises at least one of: (a) a spatially varied stiffness distribution; or (b) a spatially varied mass distribution.

18. The sound attenuating barrier of claim 17, wherein the core structure is configured so as to broaden a bandwidth by increasing the third mode resonance of the sound attenuating barrier.

19. The sound attenuating barrier of claim 17, wherein the core structure comprises at least a portion having greater stiffness than an adjacent portion of the core structure.

20. The sound attenuating barrier of claim 17, wherein the core structure comprises a variable density across the sound attenuating barrier.

21. The sound attenuating barrier of claim 17, wherein the core structure comprises an ordered three dimensional microtruss.

22. The sound attenuating barrier of claim 17, wherein at least a portion of the core structure comprises cross linking members.

23. The sound attenuating barrier of claim 17, further comprising a stiffening sheet within the core structure.

24. The sound attenuating barrier of claim 17, further comprising a stiffening layer within the core structure.

25. The sound attenuating barrier of claim 17 further comprising a layer comprising stiff materials and compliant materials within the core structure.

26. The sound attenuating barrier of claim 17, wherein the core structure comprises support structures extending between the face sheets and having a distribution of different angles across the core structure with respect to the face sheets.

27. The sound attenuating barrier of claim 17, wherein the core structure is attached to the face sheets.

28. The sound attenuating barrier of claim 17, wherein the core structure abuts the face sheets and comprises at least a portion abutting the core structure but not attached to a face sheet.

29. The sound attenuating barrier of claim 17, wherein the core structure comprises a portion adjacent to but recessed from a face sheet.

30. The sound attenuating barrier of claim 17, wherein the core structure comprises a non-uniform thickness.

31. The sound attenuating barrier of claim 30, wherein the face sheets both comprise a non-planar face sheet, and wherein opposing face sheets are symmetrical with respect to a plane extending between the non-planar face sheets.

* * * * *